United States Patent [19]

Noren

[11] Patent Number: 4,697,711

[45] Date of Patent: Oct. 6, 1987

[54] TRAY ACCUMULATOR FOR SOILED WARE CONVEYOR

[75] Inventor: Tore H. Nŏren, Petaluma, Calif.

[73] Assignee: The Stero Company, Petaluma, Calif.

[21] Appl. No.: 876,638

[22] Filed: Jun. 20, 1986

[51] Int. Cl.[4] ..... A47F 5/00

[52] U.S. Cl. ..... 211/182; 134/25.2; 134/70; 211/126; 211/133; 280/79.3

[58] Field of Search ..... 211/71, 126, 77, 78, 211/131, 133; 280/47.18, 47.19, 79.3; 134/25.2, 70

[56] References Cited

U.S. PATENT DOCUMENTS

| | | | |
|---|---|---|---|
| 2,196,131 | 4/1940 | Todd | 134/70 |
| 3,119,486 | 1/1964 | Davis | 134/70 X |
| 4,094,329 | 6/1978 | Evans | 134/70 X |
| 4,274,886 | 6/1981 | Noren | 134/25.2 |

*Primary Examiner*—Robert W. Gibson, Jr.
*Attorney, Agent, or Firm*—Biebel, French & Nauman

[57] ABSTRACT

A tray accumulator for a soiled ware conveyor comprises a tray rack adapted to be removably supported upon a dolly which is in turn supported upon and moved along a track. The dolly comprises a support frame which may be essentially permanently mounted to track rails, with all dollies being interconnected for movement as a train. The dolly comprises a support frame having front and rear members interconnected by side members, with the tray rack including an offset flange for engaging the rear member of the frame. First and second retaining brackets are secured to the side members of the frame and extend upwardly therefrom, and first and second studs are secured to the outer sides of the tray rack such that the studs fit behind the retaining brackets when the tray rack is mounted on the frame. Side rails are secured to the side members of the dolly support frame to restrain sideward movement of the tray racks relative to the dollies. The side rails extend to a position above the first and second retaining brackets, and are spaced therefrom such that the studs must be moved between the side rails and the retaining brackets for placement of the tray rack onto a dolly or removal of a tray rack from a dolly.

4 Claims, 4 Drawing Figures

TRAY ACCUMULATOR FOR SOILED WARE CONVEYOR

BACKGROUND OF THE INVENTION

The present invention relates generally to the conveyance of soiled ware such as dishes, utensils, glasses and the like in restaurants, cafeterias and similar commercial establishments, and more particularly, to an improved tray accumulator for a soiled ware conveyor.

A common practice of restaurants in handling soiled ware is to place the ware on trays which are in turn placed on endless conveyor belts to carry the trays of soiled ware to an area where the ware is washed in a commercial dishwasher. Frequently, food remnants on the soiled ware fall or drain onto the conveyor belt and lead to a disagreeable odor unless the conveyor belt is frequently cleansed.

As an improvement over the use of conveyor belts to convey soiled ware, a motor driven tray accumulator system is disclosed in U.S. Pat. No. 4,274,886. In the disclosed system, a plurality of tray accumulators or dollies including tray receiving racks are interconnected by pivoting links such that a train of dollies are continuously moved along an oval track. Rails of the track are made from tubular material which is collapsed along its inner edge to form a groove. The track is then formed by two rails positioned such that the rail grooves face each other throughout the oval track circuit.

Support wheels mounted on vertical axes are secured to the dollies and engage the grooves. Two wheels ride in each rail. One of the rails includes a pair of spaced recesses cut into its upper edge with the distance between the recesses being the same as the distance between the two wheels of the dollies that are to be received in the rail. An operator can mount a dolly on the track by first placing two of the wheels into one of the grooved rails and then aligning the other two wheels above the recesses in the other rail and lowering that end of the dolly such that the wheels pass through the recesses and onto the rail. The dolly is then free to move along the track.

Since the formation of the recesses into a rail requires additional processing and tends to weaken the rail, the recesses are typically formed only at a single location along the track and hence the dollies can be mounted to or removed from the track only at that location. To cleanse the accumulator system, the dollies can be periodically wiped clean. However, occasionally, the dollies are removed from the rails at the location including the recesses in one of the rails and then moved to a commercial dishwasher or otherwise thoroughly cleaned.

Removal of the dollies for cleansing is difficult since each dolly must be moved to the removal location and the dollies, which are preferably made from stainless steel, are quite heavy. In addition, removal of the dollies from the track requires the disassembly of the links from the dollies. It is thus apparent that the need exists for an improved tray accumulator for a soiled ware conveyor, which tray accumulator facilitates cleansing of the accumulator, and hence, promotes sanitation at the facility using the warewasher.

SUMMARY OF THE INVENTION

The problems encountered in the prior art are overcome by the improved tray accumulator of the present invention wherein a tray rack is adapted to be removably supported upon a dolly which is in turn supported upon and moved along a track circuit. The dolly comprises a support frame which may be essentially permanently mounted to track rails with all dollies being interconnected for movement as a train of dollies. Mounting means provide for retaining the tray rack to the dolly, yet permit removal of the tray rack from the dolly without requiring the use of tools, such that the tray rack is stably retained on the dolly yet can readily be removed for cleaning purposes without removing the dollies or the interconnecting links between the dollies. While it may be desirable, on occasion, to remove and clean the dollies, such removal is very infrequent and not required on a scheduled periodic basis as is the case with the tray racks. In addition, the tray racks are approximately 25% lighter in weight than the original one piece dolly assemblies which further facilitates and encourages regular periodic removal of the tray racks for cleansing purposes. Further, due to the structure of the tray racks and the dollies of the present invention, the tray racks may be removed from the dollies at essentially any position along a supporting track.

Preferably, the dolly support frame comprises a rectangular frame defined by front and rear members interconnected by side members and the mounting means comprises an offset flange secured to the bottom rear portion of the tray rack for engaging the rear member of the dolly support frame, first and second retaining brackets secured to the side members and extending upwardly therefrom, and first and second studs secured to and extending outwardly from the sides of the tray rack such that the first and second studs are positioned on the tray rack to fit behind the retaining brackets when the tray rack is mounted on the dolly support frame.

For ease of mounting the tray racks to the dollies or removing them therefrom, the improved tray accumulators may further comprise side rails secured to the side members of the dolly support frames and extending thereabove to restrain sideward movement of the tray racks relative to the dollies. Preferably, the side rails extend to a position above the first and second retaining brackets and are spaced therefrom such that the studs must be positioned between the side rails and the retaining brackets for placement of a tray rack onto a dolly or removal of a tray rack from a dolly.

It is therefore a primary object of the present invention to provide an improved tray accumulator for a soiled ware conveyor wherein tray racks are supported upon dollies such that the tray racks are stably retained for accumulating trays supporting soiled ware yet readily removable from the dollies without requiring the use of tools for cleansing purposes.

Other objects and advantages of the invention will be apparent from the following description, the accompanying drawings and the appended claims.

DETAILED DESCRIPTION OF THE INVENTION

A motor driven soiled ware conveyor to which the present invention is particularly applicable is described in detail in U.S. Pat. No. 4,274,886, which is incorporated herein by reference. Since this soiled ware conveyor is well known both due to its commercial availability and also from the referenced patent, its overall operation will be described only as necessary to provide an understanding of the present invention. Those desiring additional background information relating to the operation of the conveyor should refer to the referenced patent.

Figure 1:
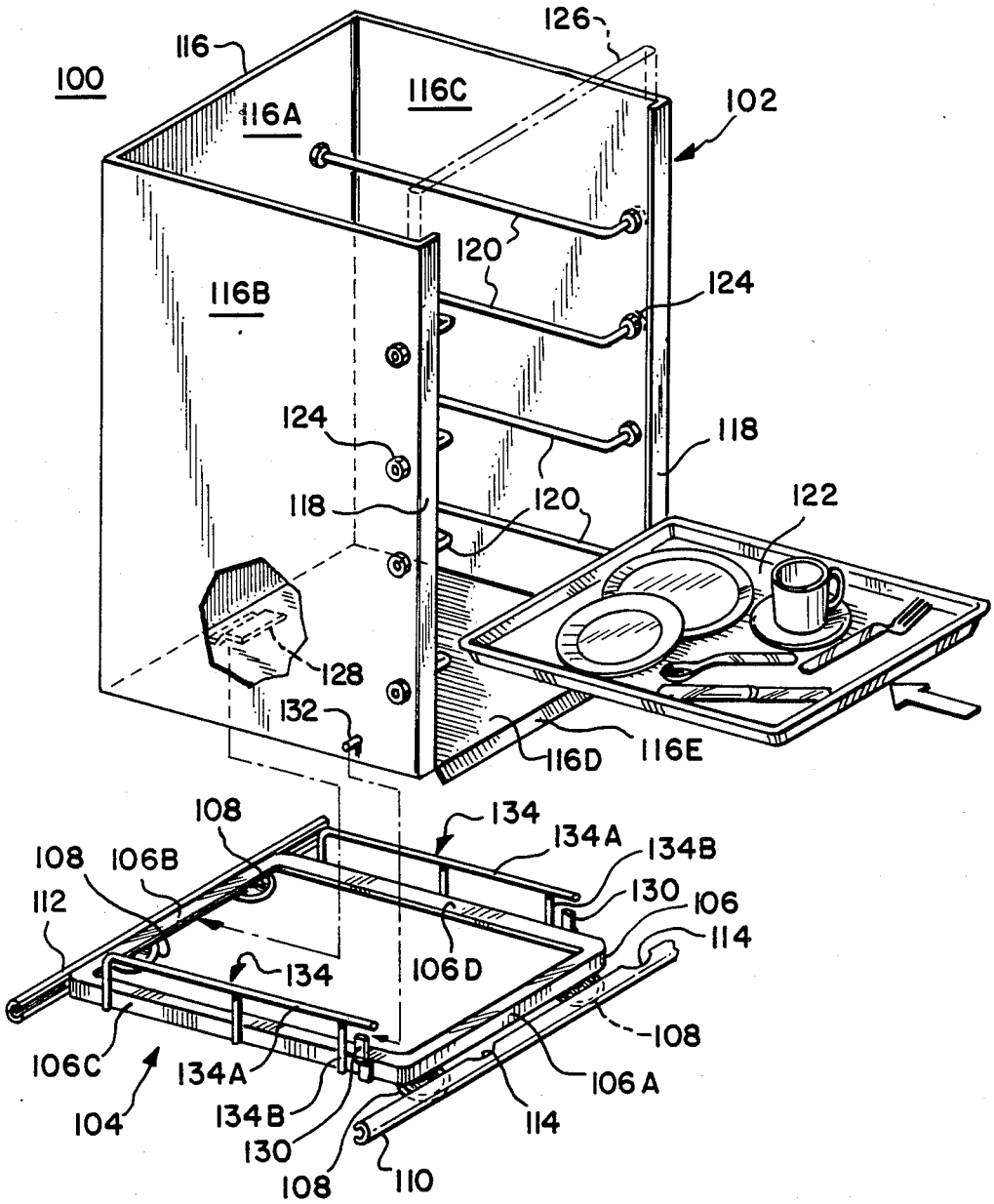
FIG. 1 is a perspective view of an improved tray accumulator for a soiled ware conveyor in accordance with the present invention.

An improved tray accumulator 100 in accordance with the present invention is shown in perspective view in FIG. 1, with a tray rack 102 being shown detached from one of the supporting dollies 104. The dolly 104 comprises a rectangular frame 106 defined by a front member 106A and a rear member 106B which are interconnected by side members 106C and 106D. Four wheels 108 are mounted for rotation about vertical axes adjacent to the four corners of the dolly frame 106. The front two wheels 108 ride in a grooved rail 110, and the rear two wheels 108 ride in a grooved rail 112.

Each of the dollies 104 may be essentially permanently mounted to the grooved rails 110 and 112 since they do not need to be removed from the rails 110 and 112 for cleansing operations performed on the tray racks 102. However, to facilitate initial assembly of the conveyor, maintenance and possible occasional cleansing of the dollies 104, it may be desirable to provide a pair of spaced apart recesses 114 in the upper edge of one of the rails 110 or 112, with the distance between the recesses being the same as the distance between the two wheels 108 supported by the associated rail such that the dollies 104 may be installed and removed from the rails 110 and 112 as disclosed in the referenced patent.

As shown in FIG. 1, the tray rack 102 is adapted to be installed without tools upon one of the dollies 104 for support upon and movement along a track defined by the rails 110 and 112. The tray rack 102 comprises a generally rectangular box 116 which is open on the front and the top and defined by a rear wall 116A, side walls 116B and 116C and a bottom wall 116D which includes a downwardly-turned flange 116E which helps prevent contamination of the dollies 104. The box 116 is stabilized by means of the contiguous bottom wall 116D, reinforcing flanges 118 on the forward edges of the side walls 116B and 116C, and the tray supporting means mounted between the side walls 116B and 116C and the rear wall 116A. The tray supporting means of the illustrated embodiment comprises a plurality of L-shaped rods 120 paired to support trays 122 which in turn support soiled ware to be conveyed to an area where the ware may be washed by a commercial dishwasher.

The ends of the L-shaped rods 120 are threaded and secured to either the side wall 116B and the rear wall 116A or the side wall 116C and the rear wall 116A by means of inner and outer threaded nuts 124, as shown, or by means of welding or other well known techniques. A cross-bar 126, while generally not necessary in accordance with the present invention, may be provided between the side walls 116B and 116C for added rigidity and stability, and also to facilitate handling of the tray rack 102.

The improved tray accumulator of the present invention includes mounting means for retaining the tray rack 102 to the dolly 104, yet permitting removal of the tray rack 102 from the dolly 104 without requiring the use of tools, such that the tray rack 102 is stably retained on the dolly 104 yet can readily be removed from the dolly 104 for cleansing purposes. The mounting means comprises an offset flange 128 which is welded or otherwise secured to the rear portion of the bottom wall 116D of the box 116. The offset flange 128 is slightly angled from the horizontal as best shown in FIGS. 2–4 such that it can securely engage the rear member 106B of the frame 106 yet permit vertical movement of the front portion of the tray rack 102 for engagement and disengagement of the tray rack 102 relative to the dolly 104 without requiring the use of tools.

First and second retaining brackets, taking the form of offset flanges 130 in the illustrated embodiment, are secured to the side members 106C and 106D and extend upwardly therefrom to retain studs 132 extending from opposite sides of the tray rack 102 to prevent forward movement of the tray rack 102 while it is engaged with the dolly 104. Finally, side rails 134 are secured to the side members 106C and 106D and extend thereabove to restrain sideward movement of the tray rack 102 relative to the dolly 104. In the illustrated embodiment of the present invention, the upper rails 134A of the side rails 134 extend to a position above the first and second retaining brackets 130 and are spaced therefrom such that the studs 132 must be positioned between the upper rails 134A of the side rails 134 and the retaining brackets 130 for placement of the tray rack 102 onto the dolly 104 or removal of the tray rack 102 from the dolly 104.

Figure 2:
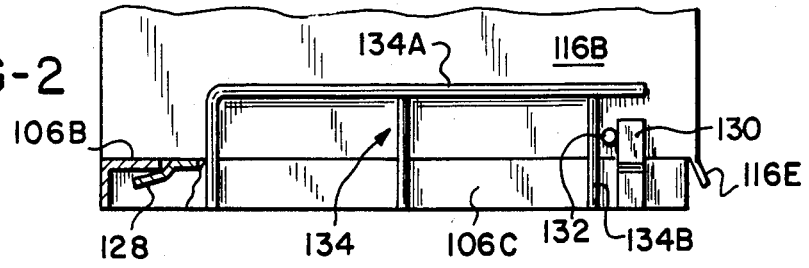
FIGS. 2–4 show a partially sectioned side view of a dolly support frame and the lower portion of a tray rack which is initially securely supported upon the frame, then lifted and slid forward to free the tray accumulator for removal from the frame without the use of tools.
Figure 3:
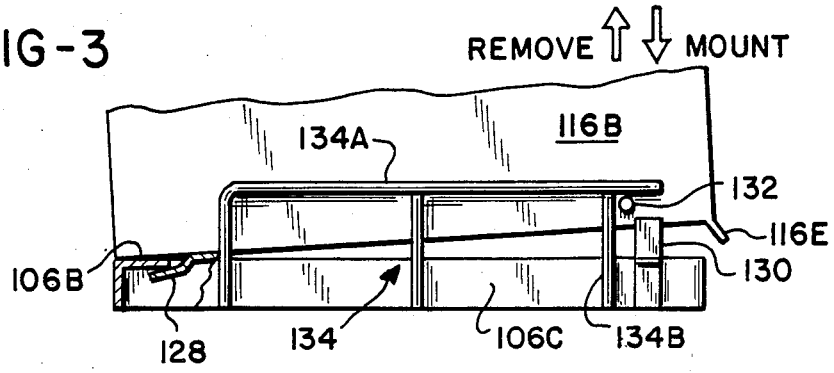
Figure 4:
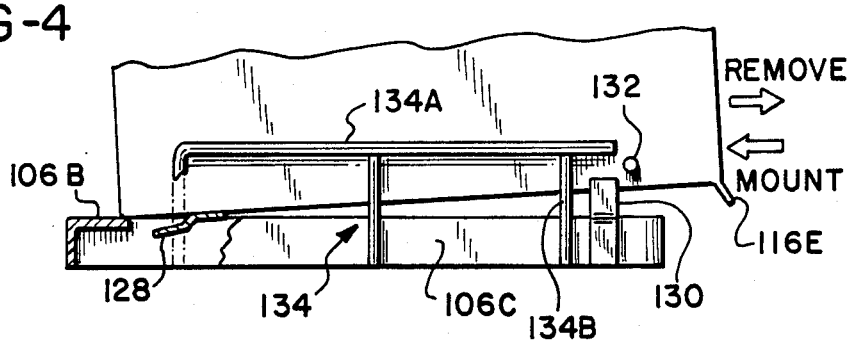

Placement and removal of the tray rack 102 onto the dolly 104 without requiring the use of tools is best shown in the schematic series of drawing FIGS. 2–4, which if viewed from FIG. 2 to FIG. 4, show the steps for removing the tray rack 102 from the dolly 104, and if viewed from FIG. 4 to FIG. 2, show placement of the tray rack 102 onto the dolly 104. In particular, as shown in FIG. 2, the tray rack 102 is positioned and retained on the dolly 104 by means of the offset flange 128 engaging the rear member 106B of the dolly frame 106 and the studs 132 being seated behind the retaining brackets 130 to prevent forward movement of the tray rack 102 relative to the dolly 104, and reinforcing the offset flange 128 by means of the forwardmost vertical rail 134B of the retaining rails 134. As can be seen, the retaining rails 134 prevent sideward movement of the tray rack 102 relative to the dolly 104, and as will be appreciated, facilitate placement and removal of the tray rack 102.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An improved tray accumulator comprising:

a dolly adapted to be supported upon and moved along a track circuit;

a tray rack adapted to be removably supported upon said dolly in retention position and;

cooperating mounting means on said rack and dolly for retaining said tray rack to said dolly, yet permitting removal of said tray rack from said dolly without requiring the use of tools, said mounting means comprising interfering portions of said tray rack and said dolly whereby said tray rack is stably retained on said dolly when in said retention position, and said interfering portions being made non-interfering by moving said tray rack out of its retention position, whereby the rack can readily be removed for cleaning purposes.

2. An improved tray accumulator comprising:

a dolly adapted to be supported upon and moved along a track circuit, said dolly comprising a rectangular frame defined by front and rear members interconnected by side members;

a tray rack adapted to be removably supported upon said dolly; and mounting means for retaining said tray rack to said dolly, yet permitting removal of said tray rack from said dolly without requiring the use of tools, said mounting means comprising an offset flange secured to the bottom rear portion of said tray rack for engaging said rear member of said frame, first and second retaining brackets secured to said side members and extending upwardly therefrom, and first and second studs secured to and extending outwardly from the sides of said tray rack, said first and second studs being positioned to fit behind said retaining brackets when said tray rack is mounted on said dolly, whereby said tray rack is stably retained on said dolly yet can readily be removed for cleaning purposes.

3. An improved tray accumulator as claimed in claim 2 further comprising side rails secured to said side members and extending thereabove for restraining sideward movement of said tray rack relative to said dolly.

4. An improved tray accumulator as claimed in claim 3 wherein said side rails extend to a position above said first and second retaining brackets and are spaced therefrom such that said studs must be positioned between said side rails and said retaining brackets for placement of said tray rack onto said dolly or removal of said tray rack from said dolly.

* * * * *